US009315936B2

(12) United States Patent
Bolduan et al.

(10) Patent No.: US 9,315,936 B2
(45) Date of Patent: Apr. 19, 2016

(54) AUTOMATICALLY CONTROLLED WASHING MACHINE HAVING A DETERGENT INLET DEVICE

(75) Inventors: Edwin Bolduan, Berlin (DE); Thoralf Greger, München (DE); Andre Sabalat, Berlin (DE); Ingo Schulze, Panketal (DE)

(73) Assignee: BSH HAUSGERÄTE GMBH, Munich (DE)

( * ) Notice: Subject to any disclaimer, the term of this patent is extended or adjusted under 35 U.S.C. 154(b) by 713 days.

(21) Appl. No.: 13/119,044

(22) PCT Filed: Jun. 15, 2010

(86) PCT No.: PCT/EP2010/058332

§ 371 (c)(1),
(2), (4) Date: Aug. 15, 2011

(87) PCT Pub. No.: WO2010/149523

PCT Pub. Date: Dec. 29, 2010

(65) Prior Publication Data

US 2012/0159998 A1 Jun. 28, 2012

(30) Foreign Application Priority Data

Jun. 23, 2009 (DE) ..... 10 2009 027 127

(51) Int. Cl.
*D06F 39/02* (2006.01)

(52) U.S. Cl.
CPC ..... *D06F 39/022* (2013.01)

(58) Field of Classification Search
CPC ..... D06F 39/022
USPC ..... 68/17 R
See application file for complete search history.

(56) References Cited

U.S. PATENT DOCUMENTS

| | | | | |
|---|---|---|---|---|
| 8,171,757 | B2 | 5/2012 | Dahlke | |
| 2005/0274156 | A1* | 12/2005 | Yang | 68/17 R |
| 2006/0021393 | A1* | 2/2006 | Oda et al. | 68/231 |
| 2007/0044517 | A1* | 3/2007 | Yang et al. | 68/17 R |
| 2007/0056328 | A1* | 3/2007 | Song | 68/17 R |
| 2007/0056329 | A1* | 3/2007 | Song | 68/17 R |
| 2007/0056330 | A1* | 3/2007 | Song | 68/17 R |
| 2007/0079637 | A1* | 4/2007 | Song | 68/17 R |

(Continued)

FOREIGN PATENT DOCUMENTS

| | | | |
|---|---|---|---|
| DE | 3403622 | A1 | 8/1985 |
| DE | 3403628 | A1 | 8/1985 |

(Continued)

OTHER PUBLICATIONS

Report of Examination EP 10 725 179.5 dated Mar. 20, 2013.

*Primary Examiner* — Michael Barr
*Assistant Examiner* — Benjamin L Osterhout
(74) *Attorney, Agent, or Firm* — Nixon & Vanderhye P.C.

(57) ABSTRACT

An automatically controlled washing machine is provided that has a housing and a detergent inlet device which is embodied as a drawer in the housing. The drawer is accessible from the front of the washing machine and has a chamber in the front region of the drawer for manual and measured addition of a portion of a laundry treatment agent. A reservoir tank inside the drawer is provided for a liquid laundry treatment agent. The reservoir tank has a chamber part that extends so far into the front region of the drawer that the chamber part is located adjacent to the chamber.

27 Claims, 4 Drawing Sheets

(56) References Cited

U.S. PATENT DOCUMENTS

| | | | | |
|---|---|---|---|---|
| 2007/0125134 | A1* | 6/2007 | Park | 68/17 R |
| 2009/0126123 | A1* | 5/2009 | Kim et al. | 8/137 |
| 2010/0300157 | A1 | 12/2010 | Schulze | |

FOREIGN PATENT DOCUMENTS

| | | | |
|---|---|---|---|
| WO | 03027377 | A1 | 4/2003 |
| WO | 2008138798 | A2 | 11/2008 |

* cited by examiner

AUTOMATICALLY CONTROLLED WASHING MACHINE HAVING A DETERGENT INLET DEVICE

BACKGROUND OF THE INVENTION

An automatically controlled washing machine having a detergent inlet device embodied as a drawer in the housing that is accessible from the front, having at least one chamber disposed in the front region of the drawer for manually measured addition of a portion of laundry treatment agent and with a reservoir tank for liquid laundry treatment agent mounted inside the drawer.

Such a washing machine is known from DE 34 03 622 A1, in which a drawer for a detergent inlet device is described which has chambers in the front region for manually measured individual portions of liquid or powder laundry treatment agents. In the drawer one or more reservoir tanks, in which liquid laundry treatment agents for multiple washing processes can be stored, are built in behind the chambers. The drawer occupies almost the entire depth of the washing machine housing at least, in order that as great a quantity of liquid laundry treatment agent as possible can be stored. To enable this reservoir tank to be filled, a refill opening is disposed on its top side that only becomes visible to and moves into a reachable position for the operator if the drawer has been pulled out of the housing of the washing machine beyond the distance which corresponds to the depth of the detergent chambers. In most cases the front edge of the work surface that ends above protrudes slightly further still, so that the distance required in order to reach the filling position is very great and thus places heavy demands on the guide of the drawer in the housing of the washing machine.

In the washing machine described in DE 34 03 628 A1, general replenishment with quantities of liquid laundry treatment agents was provided as an alternative to individual manual measuring of individual portions of liquid or powder laundry treatment agents into respective chambers arranged in the drawer. For this reason, all chambers used for holding individual portions of laundry treatment agent, as was previously the case, have been replaced by reservoir tanks. The reservoir tanks occupy the entire space that a detergent drawer between the front and rear walls of a washing machine is able to provide, with the exception of the space for one or more metering devices. The possibility of manual individual metering through a metering chamber in front of the reservoir tank, which itself serves to meter the stored laundry treatment agent, clearly shows that in no way is only one chamber provided exclusively for dispensing an individual portion of liquid or powder laundry treatment agent.

Another washing machine having a detergent inlet device embodied as a drawer in the housing accessible from the front and chambers disposed in the front region of the drawer for manually measured addition of detergent, and with a reservoir tank for liquid detergents mounted inside the drawer, is known from DE 10 2007 023 065 A1.

BRIEF SUMMARY OF THE INVENTION

The invention is based on the object of disposing reservoir tanks in the drawer in such a way that for every case of filling the reservoir tank the drawer does not need to be pulled out of the housing as far as was previously the case, despite having at least one chamber for the manually measured addition of individual portions of liquid or powder laundry treatment agent.

The invention achieves this object in the case of a washing machine described in the introduction through the characterizing features of claim 1, namely that one or more chamber parts of the reservoir tank are located adjacent to the chamber or chambers. The designer of a detergent inlet device with a reservoir tank or tanks is still free to choose how the reservoir tank or tanks and the chamber or chambers are disposed in the drawer, provided he or she ensures that the reservoir tank or tanks extend(s) at least partly into the front region of the drawer. This ensures that the operator is able to refill one of the reservoir tanks with laundry treatment agent after pulling the drawer out only a short way. This also ensures that in this position the drawer is still sufficiently well guided that even if the transport container from which the reservoir tank is to be refilled with laundry treatment agent knocks against the slightly pulled out drawer any movement caused thereby does not significantly move the drawer from the prepared position. This significantly reduces the risk of spillages.

A development of the invention in which larger regions of the reservoir tank or tanks are disposed behind the chamber or chambers of the drawer in relation to the direction in which it is to be pushed is particularly advantageous. This gives the designer great freedom with regard to how the remaining chambers for individual manually administered portions are to be disposed. Also, the greater mass of stored laundry treatment agent is then disposed in the rear region of the drawer, which protects the drawer over a longer distance from tipping forwards and downwards when being pulled out. The greater mass simply holds the drawer in guided equilibrium for longer.

If at least one of the adjoining chambers, when viewed in the direction in which the drawer is to be pushed, is shorter than the adjacent chamber or chambers, and the chamber part or parts of the reservoir tank or tanks extend(s) into the shortening space, a solution is also already available for achieving the abovementioned advantages that allows more space in which to dispose chambers for manual measurement of individual portions.

A very interesting solution to the development of the invention can be considered to be that the chamber or chambers are disposed on one side of the drawer and the reservoir tank or tanks on the other. Chambers that are disposed further back in the drawer can still be hit during the addition of manually measured individual portions without any danger of spillages when the drawer has to be pulled far out in order to reach those rear chambers. At the same time there need be no fear of a transport container knocking against the drawer because manual measurement is normally accomplished with an individual portion-sized scoop.

With the inventive disposal of reservoir tanks in the drawer limited disposal of chambers is also possible. For example, it is possible to dispense with individual portions for a prewash agent by only providing one chamber for manually measured main wash agent and one chamber for a fabric conditioner. As the most suitable fabric conditioner for manual metering from a reservoir tank is in liquid form in any case it is possible to dispense with a chamber for it and provide only one chamber for a manually measured prewash agent and one chamber for a manually measured main wash agent. As a last consequence the restriction could even go so far as only having one chamber for manually measured main wash agent and dispensing with individual portions for prewash agents and fabric conditioners. Depending on a washing machine's convenience features, a large number of possible variations are open to the designer in the use of the inventive idea.

A development in which the chamber parts of the reservoir tank have a closable refill opening disposed on their respective top sides as close as possible to the front side of the drawer is of great advantage. The disposal of the refill opening on the front side, in particular, but also its closability, should constitute a major advantage. This is because spillage out of the refill opening, particularly when the reservoir tank is full, is almost entirely avoided. Leaking laundry treatment agent could cause considerable complications for the drawer, the housing or the guide linking the two, and these are greatly reduced as a result of the closability of the refill opening.

Advantageously, in the washing machine according to the invention automatically controlled metering is made possible by the fact that an electrically-operated feed pump is provided for each reservoir tank, the suction side of which communicates with the interior of the reservoir tank. Such a feed pump will be least exposed to the risk of becoming encrusted and failing if its pressure side leads into a shaft which is in fluid communication with the detergent container of the washing machine.

The features mentioned in the subclaims can be in any useful combination, either with the main characterizing feature of claim 1 or with one another, without departing from the inventive idea.

BRIEF DESCRIPTION OF THE DRAWINGS

The invention is explained below using a number of exemplary embodiments schematically represented in the drawings, in which.

DETAILED DESCRIPTION OF EXEMPLARY EMBODIMENTS OF THE PRESENT INVENTION

Figure 1:
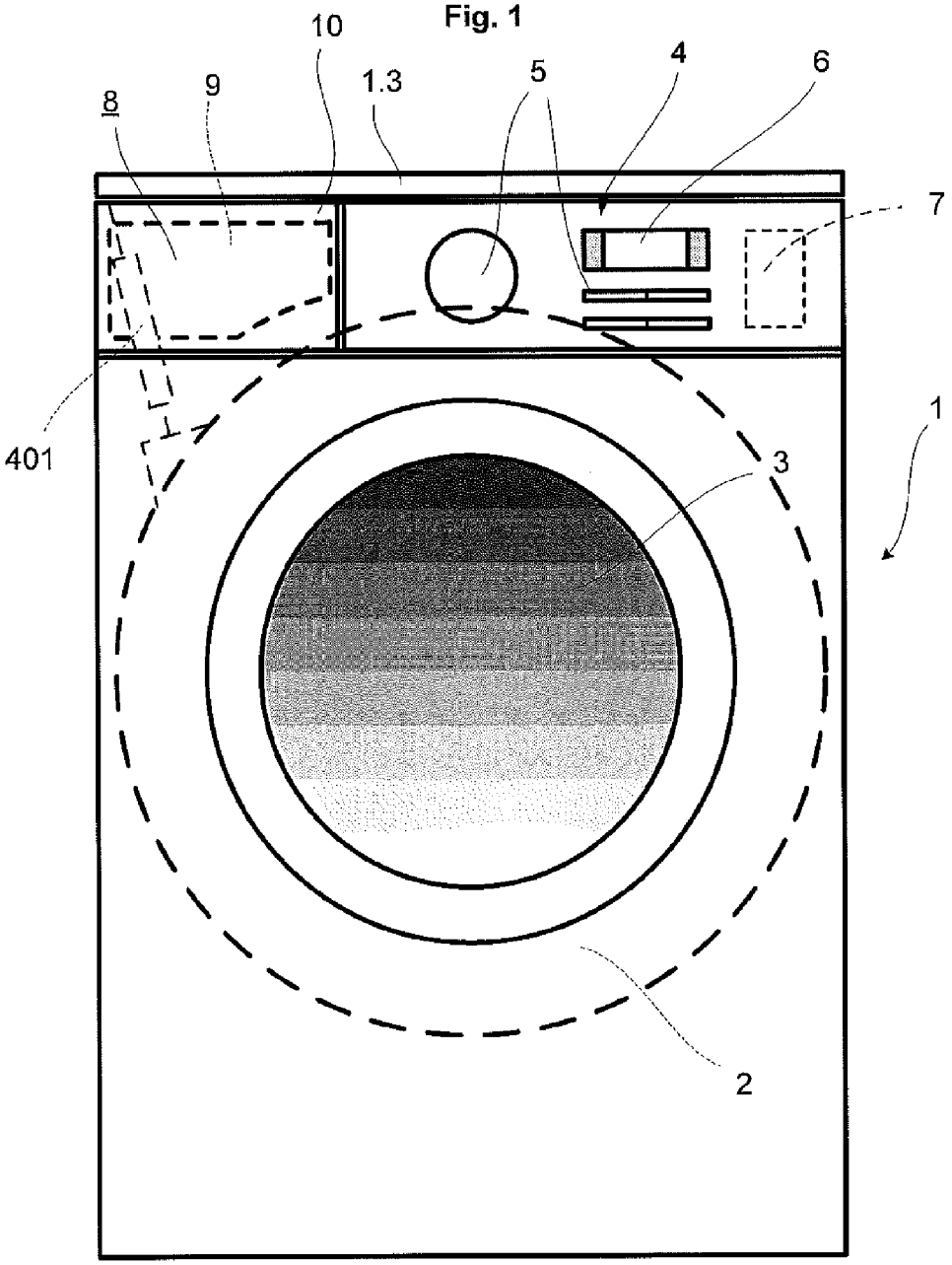
FIG. 1 shows the front view of an automatically controlled washing machine with the detergent inlet device disposed in the suspended system.

A dashed line inside the housing 1 of the washing machine in FIG. 1 indicates a suspended oscillating detergent container assembly 2, the central opening of which is closable by a front door 3. The control panel 4 mounted at the top on the front side 1.1 (FIG. 2) contains controls 5 and a display 6 for setting programs which can be displayed by a program control device 7 and are for controlling the automated processes, including those of automatic metering of laundry treatment agents.

A detergent inlet device 8 is normally disposed in the top left-hand corner of the chamber of the housing 1 and contains a drawer 9 that can be pulled out of the corresponding housing cavity. A grip plate 10 is mounted on the front side of the drawer 9 which, when the drawer 9 is fully pushed into the housing cavity, is flush with the outside of the control panel 4.

Figure 2:
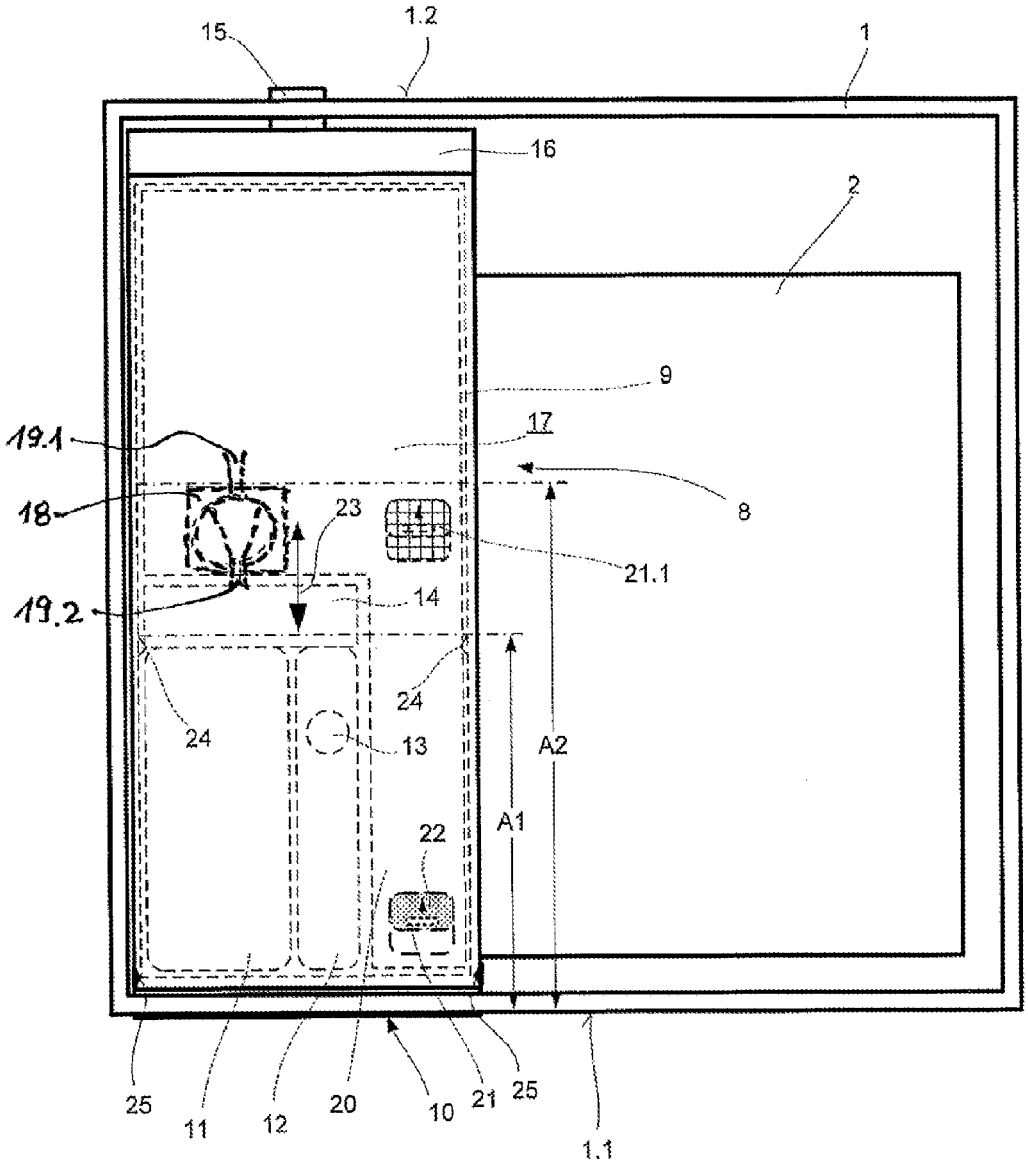
FIG. 2 shows a view of the washing machine according to FIG. 1 from above with the work surface removed.

FIG. 2 shows an exemplary embodiment of a drawer according to the invention. In this exemplary embodiment, two chambers 11 and 12 for individual, manually measured portions of laundry treatment agents are disposed in the front region of the drawer 9. The chamber 11 serves to receive main wash agent and the chamber 12, which has a generally known siphon 13 as a drain, serves to receive fabric conditioner. A shaft 14 through which the mixtures of water—fed from above, from the power supply nozzle 15 to the rear wall 1.2 of the housing 1 via a magnetic valve assembly 16 into the chambers 11 and 12—and laundry treatment agent, are transferred into the detergent container (2) via lines not shown, is disposed behind chambers 11 and 12. Behind the shaft 14, a reservoir tank 17 for the storage of a liquid or gel laundry treatment agent of which the capacity is sufficient for, for example, 20 requests for doses of laundry treatment agent, is integrated into the drawer 9, A feed pump 18 is mounted near the bottom of the reservoir tank 17, with the supply line 19.1 on its suction side; its pressure side feeds the particular dose of laundry treatment agent into the shaft 14 via a dispensing line 19.2.

With the chamber part 20 the reservoir tank 17 extends into the front region of the drawer 9, in this case even to directly behind the grip plate 10. A closable refill opening 21 with a slide 22 is disposed immediately behind the grip plate 10 on the top side of the chamber part 20.

The drawer 9 can be pushed or pulled inwards or outwards within the housing cavity, as indicated by the arrow 23, and can even be completely removed. To clearly indicate to the operator how to find the drawer position in which the chambers are easily accessible, the drawer 9 and the housing of the detergent inlet device 3 have latching devices 24 and 25 that interlock when in the correspondingly pulled out position following their movement over the distance A1.

If another chamber, for example a prewash agent chamber, were to be integrated instead of chamber part 20, as is customary in the prior art, then the refill opening 21.1 (checkered gray) of the reservoir tank 17 would still be located below the work surface 1.3 (FIG. 1) covering the washing machine. The drawer 9 would then have to be pulled out forwards over the distance A2 in order to make this refill opening 21.1, which is located far to the rear, accessible from above. In this pulled-out position far to the front the guide of the drawer 9 would already be so unstable that if a transport container or other object knocked against the drawer 9 the refill opening 21.1 would cease to be in the correlation just established with the outflowing stream of laundry treatment agent. With the drawer in this position, laundry treatment agent already flowing out of the transport container would no longer hit the refill opening but would immediately spill from the top of the reservoir tank onto part of the guide where, unless the drawer were cleaned immediately, it could cause the parts to stick together, making the guide stiff.

Figure 3:
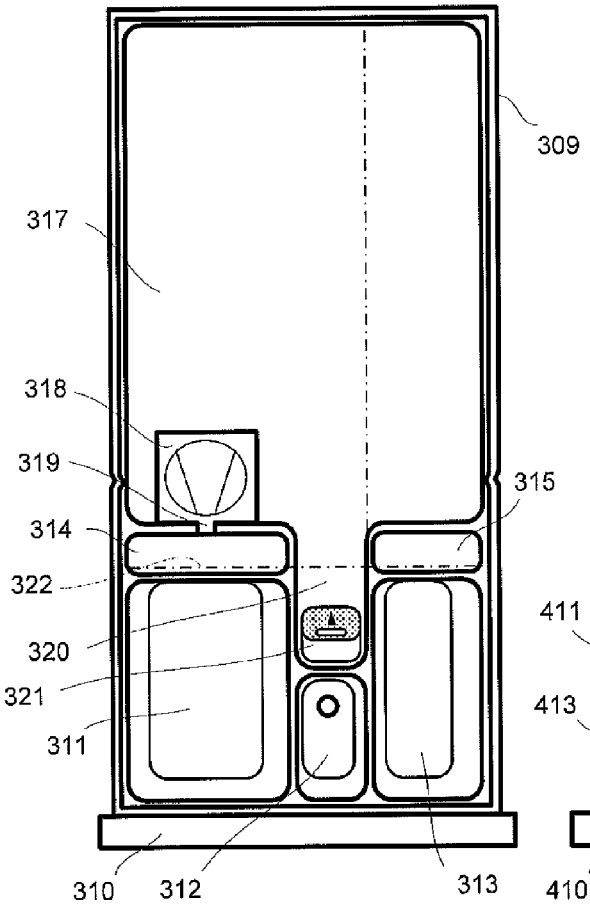
FIG. 3 shows an embodiment of the detergent drawer according to the invention when removed from the housing cavity and FIG. 4 to 10 each show different embodiments of drawers according to FIG. 3.

The drawer represented in FIG. 3 is a drawer embodied similarly to the drawer in FIG. 2. It satisfies a desire not to have to dispense with one of the chambers (the prewash chamber according to FIG. 2). This is because the fabric conditioner chamber 312 does not necessarily require as much room as shown in FIG. 2 where, in effect, it has simply been made to correspond to the depth of the main wash agent chamber 11. In FIG. 3 the fabric conditioner chamber 312 is disposed between the main wash agent chamber 311 and the prewash agent chamber 313, but not as deep as the latter (length in the direction in which the drawer 309 is pushed). As a result, the chamber part 320 can extend from the depths of the drawer 309 forwards into the free space as far as the fabric conditioner chamber 312, and the refill opening can also be disposed there. All the chambers 311 to 313 extend to directly behind the grip plate 310. The prewash agent chamber 313 is as long again as the main wash agent chamber 312; disposed behind them both is a part 314 or 315 of the shaft that is open at the top, and the water-and-detergent mixtures are carried through it to the detergent container. The drawer only needs to be pulled forwards as far as the line 322 to refill the reservoir tank 317 via the refill opening 321. When the drawer is in this position the chambers 311 to 313 are also accessible.

The dashed line in FIG. 3 is intended to show that the reservoir tank 317 can also be divided along this line in order to create a reservoir tank both to the left and to the right of the line. Then, instead of the chamber 313, the reservoir tank located to the right of the line can, with its chamber part, extend to directly behind the grip plate 310. Furthermore, under certain circumstances the chamber 312 can also be dispensed with, so that the chamber part 320 of the reservoir tank located to the left of the line also extend to behind the grip plate 310.

The exemplary embodiments for the drawers in FIGS. 4 to 10 are configured in such a way that, seen from above, springs 401 (FIG. 1) for suspending the detergent container assembly 2 are present on the upper frame of the housing 1, at approximately the point where, in FIG. 2, the feed pump 18 is disposed. For this reason, the detergent inlet devices and their drawers in FIGS. 4 to 10 are recessed at their rear left-hand side.

Figure 4:
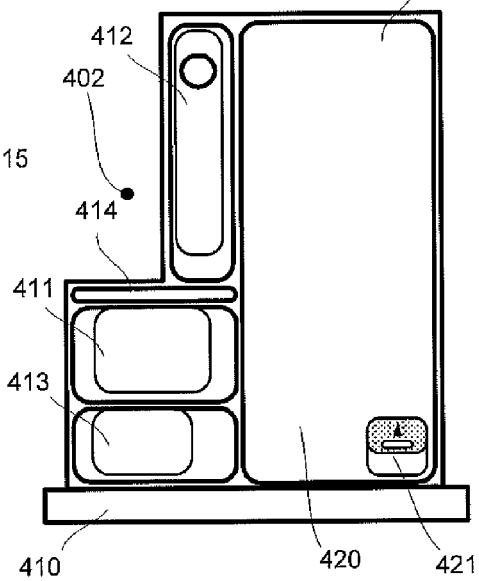
Figure 5:
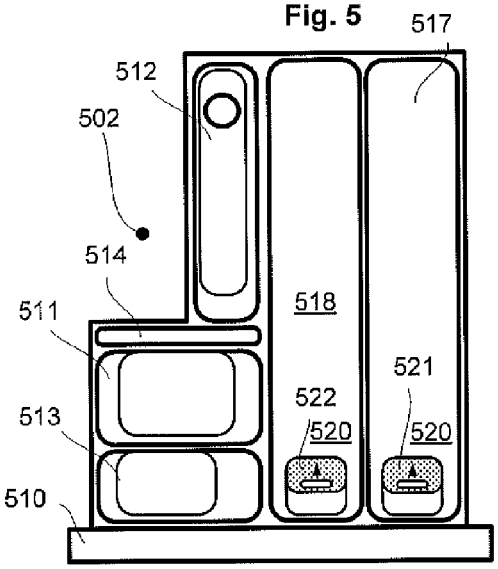
Figure 6:
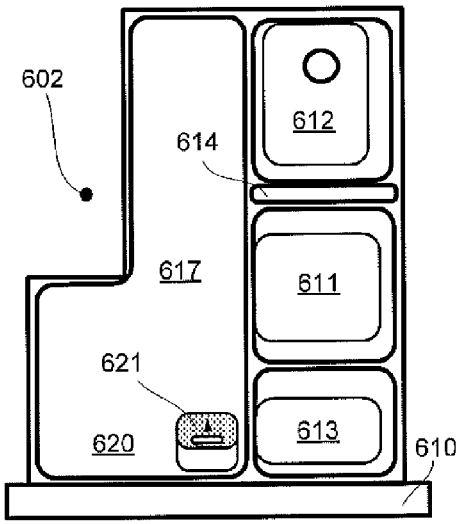

The chambers in the drawers in FIGS. 4 to 6 are disposed on one side of the drawer, both one behind the other and behind the reservoir tank or tanks. Thus, in FIGS. 4 and 5, not only the prewash agent chambers 413 and 513 but also the main wash agent chambers 411 and 511 and the fabric conditioner chambers 412 and 512 are disposed one behind the other. Also, a shaft 414 or 514 is disposed between the main wash agent chamber 411 or 511 and the fabric conditioner chamber 412 or 512 respectively. Because of its slim shape, the fabric conditioner chamber 412 or 512 is particularly suited to being disposed adjacent to the recess 402 or 502. All these chambers form a right-aligned row, wherein the prewash agent chamber 413 or 513 is located directly behind the grip plate 410 or 510.

The single reservoir tank 417 in FIG. 4 occupies the entire right-hand chamber of the drawer, which looks larger than it actually is because, as can be seen in FIG. 1, the reservoir tank 417 cannot extend very far downwards, at least on its right side, because of the suspension room required. This reservoir tank still easily has capacity for 20 portions of laundry treatment agent. This reservoir tank 417 also has a closable refill opening 421 in its top side at the front.

Unlike the drawer in FIG. 4, which has one reservoir tank 417, the drawer in FIG. 5 has two reservoir tanks 517 and 518, each with a refill opening (521 and 522) located directly behind the grip plate 510.

In the drawer in FIG. 6, the way in which the chambers 611 to 613 and the shaft 614 on the one hand and the reservoir tank 617 on the other are disposed is reversed. In this arrangement the reservoir tank 617 fits snugly around the recess 602, although even here the refill opening 621 is located directly behind the grip plate 610.

Figure 7:
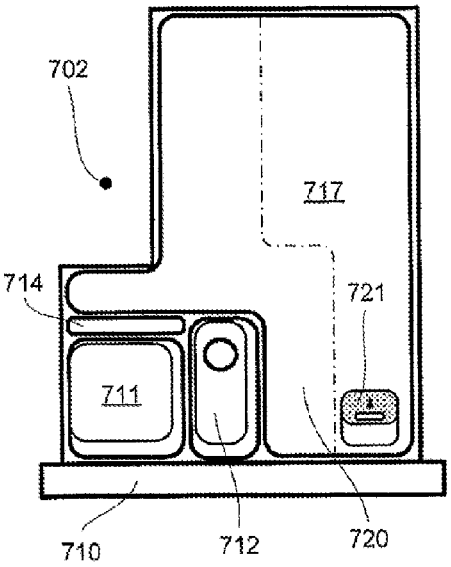
Figure 8:
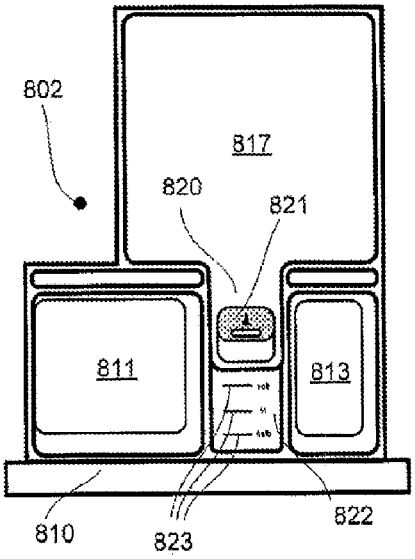
Figure 9:
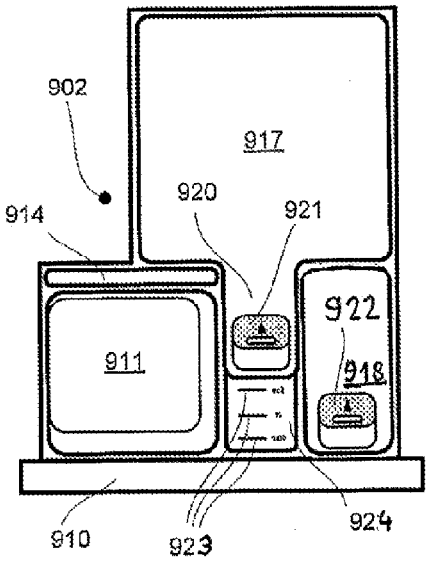
Figure 10:
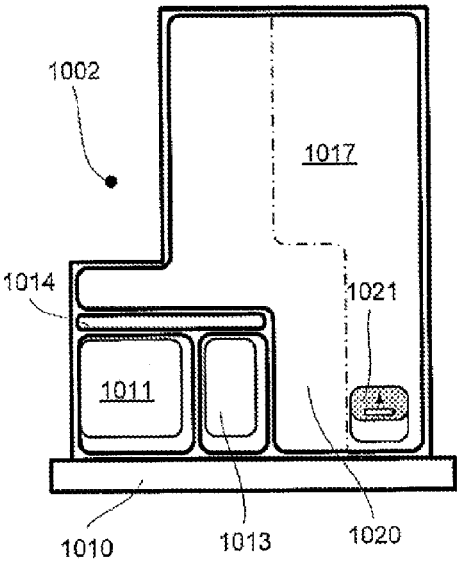

The concept of dispensing with at least one of the chambers is expressed again with the drawers in FIGS. 7 to 10—the prewash agent chamber in FIGS. 7 and 8, the fabric conditioner chamber in FIG. 10, and even both—the prewash agent chamber and the fabric conditioner agent chamber—in FIG. 9. In FIG. 7, the remaining chambers 711 and 712 for the main wash agent and the fabric conditioner are disposed next to one another directly behind the grip plate 710, while the reservoir tank 717, having one chamber part similarly to (17) in FIG. 2, is brought to directly behind the grip plate 710, so that the refill opening 721 is also located a long way forward. Instead of the one large reservoir tank 717 it is also possible to have two of them—similar to those in FIG. 5. If dividing the two containers with a straight line resulted in the volume of one container being too small it would also be possible for the dividing line to be crooked, like the dashed line in FIG. 7, although it may follow any desired crooked path. As in the other drawers, a shaft 714 is assigned to the remaining main wash agent chamber 711.

The disposal of a single main wash agent chamber 911 with shaft 914 was regarded as sufficient for the embodiment in FIG. 9 because a reservoir tank 918 is also provided for the fabric conditioner. The volume of this container 918 is only small, for example 0.5 l, because not only is fabric conditioner only added in small portions but it is also used less often than main wash agent. With its large volume (approx. 1.5 l) the reservoir tank 917 extends around the fabric conditioner container 918 from the rear but, with its chamber part 920, extends forwards to directly behind the grip plate 910. By contrast, the chamber 911 for manually measured main wash agent is disposed in the front left-hand part of the drawer 9, the chamber here also being sufficiently high (see FIG. 1) that it is not only located in the easily accessible region but makes good use of the space in front of the recess 902. Both reservoir tanks 917 and 918 have refill openings 921 and 922 disposed at the front.

In FIG. 8 the fabric conditioner chamber 813 and the main wash agent chamber 811 are located separately from one another. Accordingly, the chamber part 820 of the reservoir tank 817 extends far forward between the two chambers 811 and 813 to directly behind the grip plate 810. Also here, a prismatic embodiment is provided in the frontmost section of the chamber part 820 that has a surface 822 which appears sloping to the observer. Provided the material of which the reservoir tank 817 is made is at least translucent, it is possible to see from the markings 823 on this sloping surface whether the reservoir tank 817 is still half, three quarters or completely full.

The drawer in FIG. 10 is embodied similarly to the exemplary embodiment in FIG. 7, except that a prewash agent chamber 1013 that shares a shaft 1014 with the main wash agent chamber 1011 is integrated instead of the fabric conditioner chamber 712. The reservoir tank 1017 has a very similar shape to the reservoir tank 717 and can be divided along the dashed dividing line in the same way as the latter.

As already mentioned above, the inventive embodiment of the drawer of a detergent inlet device allows the designer every imaginable freedom with regard to how the drawer is divided and to the individual disposal and adjustment of the volume of the chambers and the reservoir tanks, which means that the embodiments represented here only reveal a small number of the many possibilities. Where there is a sufficient number of reservoir tanks—or the volume thereof is sufficient—for example, even where there are two or three reservoir tanks—a single chamber for manually measured main wash agent can be sufficient in order to leave sufficient room in which to dispose two or three reservoir tanks, or to enlarge them. The position immediately behind the grip plate in which this main wash agent chamber would be integrated could be dictated by expediency, considerations concerning the correct ratio between the volumes or the drawer's practicality in use. A particularly practical arrangement is shown in FIG. 9.

LIST OF REFERENCE CHARACTERS

| List of reference characters | |
|---|---|
| 1 | housing |
| 1.1 | front side |
| 1.2 | rear wall |

-continued

| List of reference characters | |
|---|---|
| 1.3 | work surface |
| 2 | detergent container assembly |
| 3 | front door |
| 4 | fascia panel |
| 5 | controls |
| 6 | display |
| 7 | program control device |
| 8 | detergent inlet device |
| 9 | drawer |
| 10, 310, 410, 510, 610, 710, 810, 910, 1010 | grip plate |
| 11, 12, 311, 312, 313, 411, 412, 413, 511, 512, 513 | chamber |
| 611, 612, 613, 711, 712, 811, 813, 911, 912, 1011, 1012 | chamber |
| 13 | siphon |
| 14, 314, 315, 414, 514, 614, 714, 814, 914, 1014 | shaft |
| 15 | power supply nozzle |
| 16 | magnetic valve assembly |
| 17, 317, 417, 517, 518, 617, 717, 817, 917, 918, 1017 | reservoir tank |
| 18, 318 | feed pump |
| 19.1 | supply line |
| 19.2, 319 | dispensing line |
| 20, 320, 420, 520, 620, 720, 820, 920, 1020 | chamber part |
| 21, 21.1, 321, 421, 521, 522, 621, 721, 821, 921, 922, 1021 | refill opening |
| 22 | slide |
| 23 | direction in which pushed |
| 24, 25 | lock-in devices |
| 322 | line |
| 401 | spring |
| 402, 502, 602, 702, 802, 902, 1002 | recess |
| 822, 924 | surface appearing sloping to the observer |
| 823, 923 | marking |
| A1, A2 | distance |

The invention claimed is:

1. An automatically controlled washing machine, comprising:

a housing; and a detergent inlet device embodied as a drawer in the housing that is accessible from the front of the automatically controlled washing machine, the drawer having a front region, a rear region, and a chamber disposed in the front region of the drawer for manual and measured addition of a portion of a laundry treatment agent, and the drawer having a reservoir tank inside the drawer for a liquid laundry treatment agent;

wherein the reservoir tank has a front portion located in the front region of the drawer such that the front portion is located adjacent to the chamber in a width direction of the drawer and wherein the reservoir tank has a rear portion located in the rear region of the drawer; and the front portion is configured to extend into the front region of the drawer such that the drawer is only required to be pulled out less than a depth of the chamber to be able to add liquid laundry treatment agent to the reservoir and the rear portion extends backwards into the drawer farther than the chamber.

2. The washing machine of claim 1, wherein larger regions of the reservoir tank are disposed behind the chamber of the drawer in relation to a direction in which the drawer is pushed.

3. The washing machine of claim 2, wherein, when viewed in the direction in which the drawer is pushed, one of a plurality of chambers that are located adjacent to one another is shorter than an adjacent chamber, and wherein the chamber part of the reservoir tank extends into a shortening space.

4. The washing machine of claim 1, wherein the chamber is disposed on one side of the drawer and the reservoir tank is disposed on another side of the drawer.

5. The washing machine of claim 1, comprising only one chamber for a manually measured main wash agent and only one chamber for a fabric conditioner.

6. The washing machine of claim 1, comprising only one chamber for a manually measured prewash agent and only one chamber for a manually measured main wash agent.

7. The washing machine of claim 1, comprising only one chamber for a manually measured main wash agent.

8. The washing machine of claim 2, wherein the chamber part of the reservoir tank has a closable refill opening disposed on a top side of the chamber part and at a predetermined close proximity to a front side of the drawer.

9. The washing machine of claim 2, further comprising a detergent container and an electrically-driven feed pump for the reservoir tank, the electrically-driven feed pump having a suction side that communicates with the interior of the reservoir tank and a pressure side that leads into a shaft which is in fluid communication with the detergent container.

10. A drawer for a washing machine, the drawer comprising:

a chamber arranged in a front of the drawer to receive a manually dosed first laundry detergent agent; and a storage tank configured to receive and store a liquid second laundry detergent agent;

wherein:

the storage tank is covered by a cover, the storage tank having a first portion and a second portion, the first portion being forward in the drawer relative to the second portion and the second portion being extended from the first portion backwards in the drawer;

the cover is configured to move with the drawer and to have an opening configured to open to fill the liquid second laundry detergent agent into the storage tank and to close when the liquid second laundry detergent agent is not being added into the storage tank; and when looking at a front of the drawer, the first portion of the storage tank is arranged to be at least partially to the left or to the right of the chamber and the second portion of the storage tank is arranged at least partially farther backwards in the drawer than the chamber.

11. The drawer of claim 10, wherein the second portion of the storage tank is arranged to be at least partially aligned with the chamber in a withdrawal direction of the drawer.

12. The drawer of claim 10, wherein the chamber is one of a plurality of chambers that are adjacent to one another.

13. The drawer of claim 12, wherein one of the plurality of chambers is shorter than remaining ones of the plurality of chambers, and wherein the first portion of the storage tank extends into a space provided by the one of the plurality chambers that is shorter than the remaining ones of the plurality of chambers.

14. The drawer of claim 12, wherein a first chamber of the plurality of chambers receives a manually dosed main wash agent, and wherein a second chamber of the plurality of chamber receives a manually dosed fabric conditioner.

15. The drawer of claim 12, wherein only a first chamber of the plurality of chambers receives a manually dosed prewash agent, and wherein only a second chamber of the plurality of chambers receives a manually dosed main wash agent.

16. A washing machine, comprising a drawer having:

a chamber arranged in a front section of the drawer to receive a manually dosed first laundry detergent agent; and a storage tank configured to receive and store a liquid second laundry detergent agent;

wherein:

the storage tank is covered by a cover, the storage tank having a first portion and a second portion, the first portion being forward in the drawer relative to the second portion and the second portion being extended from the first portion backwards in the drawer;

the cover is configured to move with the drawer and to have an opening configured to open to fill the liquid second laundry detergent agent into the storage tank and to close when the liquid second laundry detergent agent is not being added into the storage tank; and when looking at a front of the drawer, the first portion of the storage tank is arranged to be at least partially to the left or to the right of the chamber and the second portion of the storage tank is arranged at least partially farther backwards in the drawer than the chamber.

17. The washing machine of claim 16, further comprising:

a drum;

a pump having a suction side and a pressure side; and a shaft in fluid connection with the drum;

wherein the suction side of the pump communicates with an interior of the storage tank; and wherein the pressure side of the pump pumps the liquid second laundry detergent into the shaft.

18. The washing machine of claim 17, wherein the pump is an electrically-driven feed pump.

19. The washing machine of claim 16, wherein the second portion of the storage tank is arranged to be at least partially aligned with the chamber in a withdrawal direction of the drawer.

20. The washing machine of claim 16, wherein the chamber is one of a plurality of chambers that are adjacent to one another.

21. The washing machine of claim 20, wherein one of the plurality of chambers is shorter than remaining ones of the plurality of chambers, and wherein the first portion of the storage tank extends into a space provided by the one of the plurality chambers that is shorter than the remaining ones of the plurality of chambers.

22. The drawer of claim 20, wherein a first chamber of the plurality of chambers receives a manually dosed main wash agent, and wherein a second chamber of the plurality of chamber receives a manually dosed fabric conditioner.

23. The drawer of claim 20, wherein only a first chamber of the plurality of chambers receives a manually dosed prewash agent, and wherein only a second chamber of the plurality of chambers receives a manually dosed main wash agent.

24. An automatically controlled washing machine, comprising:

a housing; and a detergent inlet device, the detergent inlet device comprising a drawer having a front section and a rear section;

wherein:

the front section is accessible before the rear section when the drawer is pulled from the housing;

the drawer comprises at least a chamber disposed in the front section and is configured to receive a manual and measured addition of a first laundry treatment agent;

the drawer further comprises a reservoir tank configured to receive and store a liquid laundry treatment agent, the reservoir tank comprising a first part arranged in the front section and a second part arranged in the rear section; and the first part is configured to extend into the front region of the drawer such that the drawer is only required to be pulled out less than a depth of the chamber to be able to add liquid laundry treatment agent to the reservoir and the second part extends backwards into the drawer farther than the chamber.

25. The washing machine according to claim 24, wherein the second part of the reservoir tank is larger than the first part of the reservoir tank.

26. The washing machine according to claim 24, wherein the second part of the reservoir tank remains within the housing of the washing machine until the drawer is pulled out from the housing a distance equal to at least a length of the chamber.

27. The washing machine according to claim 24, wherein the reservoir tank includes a cover, the cover being configured to remain atop the reservoir tank when the drawer is open or closed, and the cover includes a closable refill opening disposed on the cover in the first part of the reservoir tank.

* * * * *